United States Patent [19]

Stoddart

[11] Patent Number: 4,809,813

[45] Date of Patent: Mar. 7, 1989

[54] LINEMAN'S GAFF BUCKLE

[76] Inventor: Mike Stoddart, 1818 Linwood St., San Diego, Calif. 92110

[21] Appl. No.: 32,578

[22] Filed: Apr. 1, 1987

[51] Int. Cl.[4] ..... A62B 35/00

[52] U.S. Cl. ..... 182/9

[58] Field of Search ..... 182/9, 221, 3

[56] References Cited

U.S. PATENT DOCUMENTS

| | | | |
|---|---|---|---|
| 869,382 | 10/1907 | Newton | 182/9 |
| 1,120,496 | 12/1914 | Holsclaw | 182/9 |
| 2,853,220 | 9/1958 | Thomas | 182/3 |
| 3,407,898 | 10/1968 | Johnson | 182/9 |
| 3,840,091 | 10/1974 | Conlon | 182/9 |
| 4,579,196 | 4/1986 | Allen | 182/9 |

*Primary Examiner*—Reinaldo P. Machado

*Attorney, Agent, or Firm*—Selwyn S. Berg

[57] ABSTRACT

A buckle is described which is to be attached to the lineman's safety belt, the buckle has a multiplicity of short and long rows claws on the front side of a plate and these claws penetrate into the wooden pole the lineman is climbing, on the backside of the plate, there is a lock for keeping, locking, and pining the buckle to the safety belt, the multiplicity of rows of claws are designed so as to drive the claws into the pole and pivoting the buckle around some of the claws if the lineman experiences a fall.

1 Claim, 1 Drawing Sheet

LINEMAN'S GAFF BUCKLE

SUMMARY OF THE INVENTION

Electrical lines of all kinds, be it for power or communication, continues to be strung from pole to pole. For the most part, poles used are made of wood, which is treated to retard rot from the elements and contact with the soil. Some of these poles have built-in ladders. However, most of them have no systems of access to their pinnacle. To service the line running along the pinnacle of the pole, a lineman must somehow climb it. The usual means is to have spur devices which are attached to one's boots; these spurs have sharp points which a trained lineman drives into the pole when he ascends. To maintain his balance, he may grasp the pole or have a belt which goes around his upper torso and the pole. The lineman works the belt upward as he progresses up the pole. Occasionally, he must reposition the belt around obstructions located on the pole.

This is a hazardous job because of the consequences of an error or slip. If the spurs should happen to disengage the pole or slip, the lineman has no other restraint. He would fall earthward or his belt may hang up and break his fall after some distance. Depending on the distance of his fall, a quick stop by the belt could break his back.

The invention, A Lineman's Gaff Buckle describes a simple attachment to the belt which would rapidly engage into the pole should the lineman slip.

REFERENCE TO DRAWINGS

DETAILED DESCRIPTION OF THE EMBODIMENT

Figure 1:
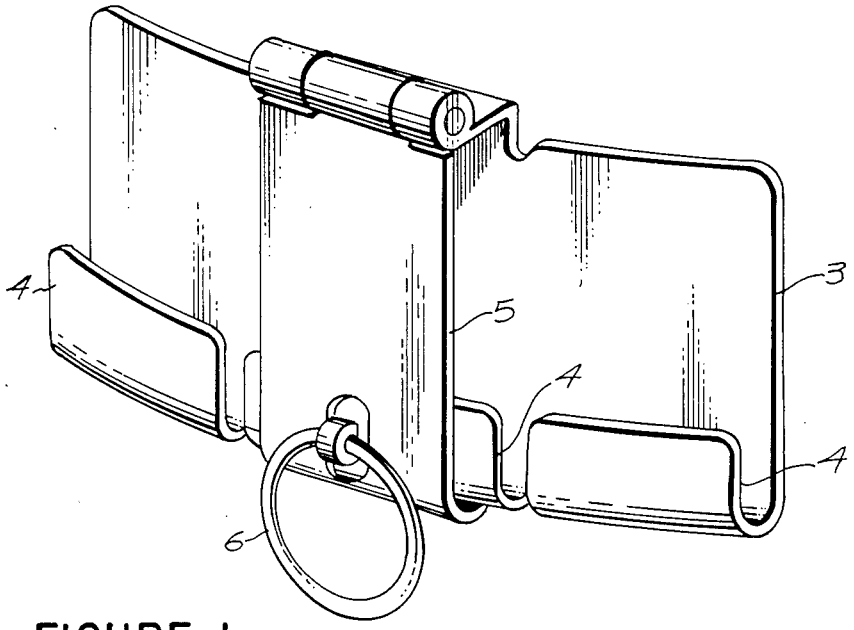
FIG. 1 shows the front view of the buckle.
Figure 2:
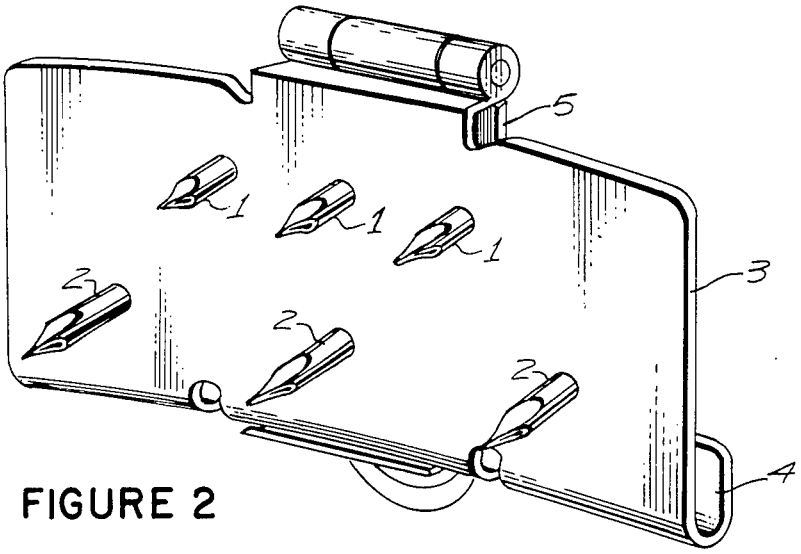
FIG. 2 shows the back view of the buckle with claws.

The Lineman's Gaff Buckle comprises a series of parallel lines of a multiplicity of sharp points firmly imbedded in a backing plate (3). The points act as claws which bury themselves into the outer surface of a wooden pole when subject to adequate pressure on the outer surface of the backing plate. On the outer surface of the backing plate, there is a keeper (4) with a lock (5) and pin (6) for engaging the safety belt that linemen use when climbing poles. Critical to the utility of this invention is the placement of a shorter set of claws, called the grasping claws (1), above a lower set of claws called the pivoting claws (2) and located slightly below the midplane of the backing plate (3). The backing plate is slightly contoured so as to coincide with an extended circumference of some average power pole. The claws are located on the inside of the circumferencial backing plate and on the outside of the backing plate is located a belt keeper (4) with a lock (5) and pin (6). The keeper (4) engages the edge of the belt and the lock (5) encloses the belt to the backing plate. When one is ascending or descending a pole, only the longer pivot claws (2) superficially penetrate the outer surface of the pole. The lineman has no difficulty in disengaging these pivot claws from said outer surface so as to slide the belt to a new position. If the lineman should slip, the buckle pivots around the point of engagement of the pivot claws (2) and drives the upper set of shorter grasping claws (1) deep enough into the surface of the pole to prevent the belt from falling any further. After the lineman has regained his equilibrium and has repositioned his spurs into the pole, he may either work the gaff buckle out of the surface or remove the pin and unlock the belt from the keeper and descend back to safety.

The Lineman's Gaff Buckle may be considered expendable and is a simple device designed to fit all safety belts currently in use. The embodiment as shown in the accompanying drawings is not intended to limit the claims thereto. In the embodiment of the Lineman's Gaff Budkle, the multiplicity of the pivot claws (2) comprises three nail-like protrusions approximately one inch (2.5 cm) high. The center claw bisects the backing plate and is perpendicular to the backing plate (3). The distance between each of the pivot claws is approximately an inch and one-half (4 cm). This lower line of pivot claws is approximately one-quarter inch (0.6 cm) below the longitudinal center line of the backing plate. The second line of claws comprises three nail-like protrusions from the backing plate approximately half-way between the upper edge of the backing plate and the line containing the pivot claws. These short grasping claws (1) are approximately one-quarter of an inch (0.6 cm) shorter than the pivot claws. The center grasping claw is on the center line of the backing plate and in a line perpendicular to the edge of the backing plate containing the center pivot claw. Each of the other two grasping claws is about three-quarters of an inch (2 cm) on either side of the center claw. All claws are firmly imbedded into the backing plate. The backing plate (3) is bowed into a segment of the section of the large circumference so that all the claws point to a radial center line. On the front surface of the backing plate is a keeper (4) designed to engage the edge of a belt. On the center line is a hasp which acts as a lock (4) engaging the belt in the keeper. The hasp folds up against the keeper and is held in place by a locking pin (6). The Lineman's Gaff Buckle may be placed on any lineman's climbing belt by opening the hasp and slipping the keeper around the lower edge of said belt. By closing the hasp and engaging the same with the locking pin, the belt is secured to the gaff buckle. For the proper operation of this Lineman's Gaff Buckle, the grasping claws must be in the horizontal plane above the pivot claws. This is to assure that when the safety belt is pulled downward, the buckle pivots on the lower claws and the upper short claws are driven into the pole by the shock of the short dissent.

I claim:

1. Lineman's gaff buckle which fits onto a safety belt encompassing both a lineman and a wooden pole to be climbed, comprising an arcuate backing plate having an inside and an outside circumference, said inside circumference contoured to the diameter of said wooden pole, said backing plate having locking means on the outside of said circumference engaging said safety belt, said locking means holding said safety belt with the outside circumference of said backing plate, and said backing plate having on the inside circumference, a multiplicity of claws in a multiplicity of rows located one above the other of the longitudinal center line of said backing plate, the claws of the row located below said longitudinal center line are longer than the claws of the row positioned above said longitudinal center line so that if the lineman slips on the pole, he will be cradled in the safety belt which is kept locked to the buckle and the rows of claws are driven into the pole by the shock of the initial slip.

* * * * *